US005230905A

United States Patent [19]

Fare et al.

[11] Patent Number: 5,230,905

[45] Date of Patent: Jul. 27, 1993

[54] POLYMER EXTRUDING DEVICE

[75] Inventors: Maurilio Fare; Rosaldo Fare, both of Fagnano Olona, Italy

[73] Assignee: Fare' S.p.A., Fagnano Olona, Italy

[21] Appl. No.: 715,495

[22] Filed: Jun. 14, 1991

[51] Int. Cl.[5] ..... B29C 47/88; B29C 71/00; B28B 5/00

[52] U.S. Cl. ..... 425/72.2; 264/211.14; 264/237; 425/378.2; 425/464

[58] Field of Search ..... 425/72.21, 72.1, 7, 425/192.5, 378.2, 382.2, 464, 8; 264/12, 176.1, 237, 39, 211.14

[56] References Cited

U.S. PATENT DOCUMENTS

| | | | |
|---|---|---|---|
| 3,650,716 | 3/1972 | Brossard | 425/8 |
| 3,847,522 | 11/1974 | Heckrotte et al. | 425/72.2 |
| 3,959,057 | 5/1976 | Smith | 425/72.2 |
| 4,124,666 | 11/1978 | Wilhelm et al. | 264/39 |
| 4,259,048 | 3/1981 | Miani | 425/72.2 |
| 4,277,436 | 7/1981 | Shah et al. | 425/8 |
| 4,340,341 | 7/1982 | Cardell | 264/237 |
| 4,505,657 | 3/1985 | Ikeya | 264/237 |
| 4,643,750 | 2/1987 | Glaser | 425/72.2 |
| 4,750,874 | 6/1988 | Keim | 425/72.1 |
| 4,838,774 | 6/1989 | Balk | 264/176.1 |
| 4,937,020 | 6/1990 | Wagner et al. | 425/8 |
| 4,988,270 | 1/1991 | Stibul et al. | 425/72.2 |
| 5,100,450 | 3/1992 | Cunningham | 425/8 |
| 5,114,631 | 5/1992 | Nyssen et al. | 425/8 |
| 5,178,814 | 1/1993 | Lemond | 425/378.2 |

FOREIGN PATENT DOCUMENTS

| | | | |
|---|---|---|---|
| 46-34926 | 3/1971 | Japan | 264/237 |
| 62-207624 | 9/1987 | Japan | 264/237 |

*Primary Examiner*—Jay H. Woo
*Assistant Examiner*—Joseph Leyson
*Attorney, Agent, or Firm*—Dority & Manning

[57] ABSTRACT

An apparatus for extruding molten polymeric material into a plurality of filaments. The apparatus includes a pack which has a distribution plate and a circular spinneret positioned below the distribution plate. A quenching head is carried within and below the circular spinneret and includes a plurality of concentric hubs carried on a cylindrical tubular main body. Each of the concentric hubs has an upwardly inclined wall adjacent an upper portion of the hub which defines an incline annular passage which extends upwardly towards the spinneret through which quenching air is fed from the cylindrical tubular body through the passages for cooling the filaments being produced by the spinneret.

5 Claims, 2 Drawing Sheets

POLYMER EXTRUDING DEVICE

BACKGROUND OF THE INVENTION

This invention relates to an improved process and apparatus for melt spinning filaments from synthetic polymers. Melt spun filaments from polymers such as polyester, polyamides and polyolefins, etc. are usually produced by extruding molten polymer through a filter and a spinneret and the filaments so formed are cooled to prevent coalescence and then wound up on a bobbin or forwarded to other processing steps. The way in which the filaments leaving the spinneret are cooled has a pronounced effect on their properties and it is generally accepted that some form of imposed quench is required if uniformity in the cooling of the fibers to be achieved.

Attempts have been made to use concentrated flows of air to cool the filaments. However, it is important that vibrations not be imparted to the filaments during the cooling operation or it could adversely affect the properties of the filaments. There have been many different processes and apparatuses that have been proposed for cooling the filaments. One such device disclosed in U.S. Pat. No. 4,259,048 which teaches quenching the filaments with a single laminar centrifugal discoidal jet of cooling air which impinges perpendicularly against the just extruded yarn close to the die holes of the spinneret.

Another attempt to quench the yarn is disclosed in U.S. Pat. No. 3,969,462 which discloses passing the extruded filaments first through a heated zone which maintains the filament molten for intervals below the spinneret face and subsequently quenching the filaments with a radial outflow of cooling gases. The cooling gases pass through a quench stick which is preferably made of porous material such as ceramic or sintered metal so as to minimize the forces imparted to the filaments during the cooling operation.

Still another attempt to quench the filaments in melt spinning of synthetic fibers is disclosed in U.S. Pat. No. 4,045,534 which teaches passing the filaments directly into a heated sleeve having walls that are imperforate and then leading the filaments to a quenching chamber where they are cooled.

SUMMARY OF THE INVENTION

The invention comprises a method and apparatus for extruding molten polymeric material such as polypropylene, polyester and nylon into filaments. The molten polymeric material is supplied by any suitable source to a pair of channels provided in the distribution plates forming part of the pack. The pair of channels extend in a semicircular path, then turn radially inwardly towards the center of the distribution plate. From that point, they travel approximately 90 degrees to the 90 and 270 degree quadrants where they split into four channels that are in turn connected to feeder channels that feed the molten material to circumferentially spaced holes provided in the distribution plate.

Such paths of travel for the molten material creates uniform heating and pressure within the distribution plates by providing substantially equal length paths of travel of the molten polymeric material to each of the holes in the distribution plate. The molten material then passes through a circular spinneret which has a plurality of holes or capillaries therein through which the filaments are extruded. The extruded filaments are quenched as they pass through the spinneret by three streams of air which are directed upwardly towards the exit hole of the spinneret at obtuse angles to the filaments being extruded.

The quenching head is carried within the cylindrical configuration formed by the filaments passing through the spinneret and has three hubs that can be rotated for controlling the rate and volume of air passing through the inclined slits for directing the air towards the filaments being extruded. The entire quenching head can be raised and lowered relative to the bottom of the spinneret for controlling the effect of the quenching air.

It is, therefore, an object of the present invention to provide a method and apparatus for extruding molten polymeric material into filament.

Another important object of the present invention is to provide a method and apparatus for extruding polymeric filaments of uniform physical properties.

Another important object of the present invention is to provide a method and apparatus for maintaining uniform pressure and temperature of molten polymeric material as it is being extruded into a plurality of filaments.

Still another important object of the invention is to provide a method and apparatus for quenching filaments of extruded polymeric material in such a manner to avoid turbulence in the cooling air and vibrations in the filaments.

Still another important object of the present invention is to provide a quenching system wherein streams of air of different velocity and volume can be used for cooling the filaments being extruded.

These and other objects of the invention will become apparent to those skilled in the art from a description of the invention which follows:

DESCRIPTION OF THE PREFERRED EMBODIMENT

Figure 1:
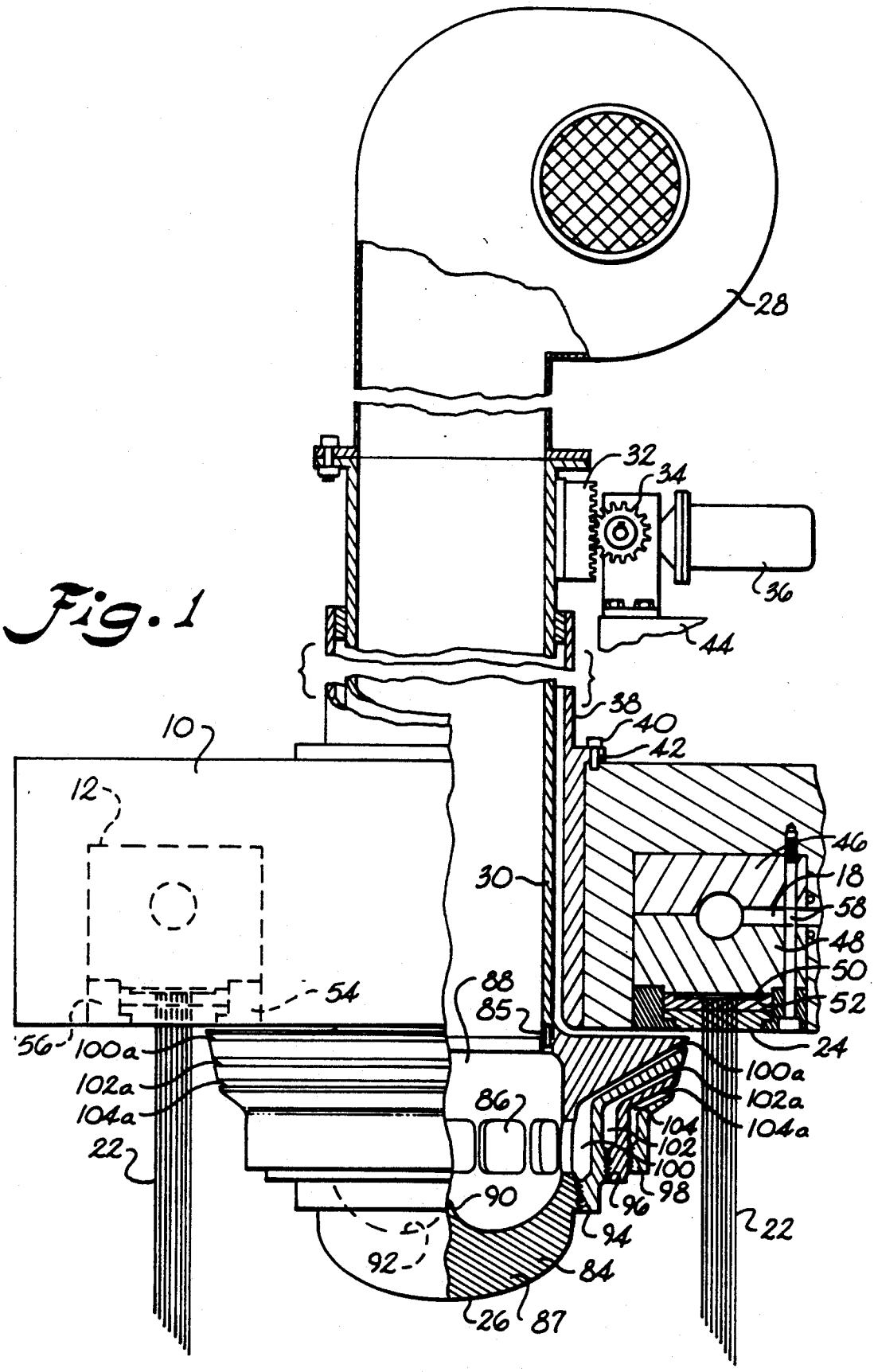
FIG. 1 is a front elevational view partially in section and partially in schematic form illustrating an apparatus for extruding polymeric filaments in accordance with the present invention.
Figure 2:
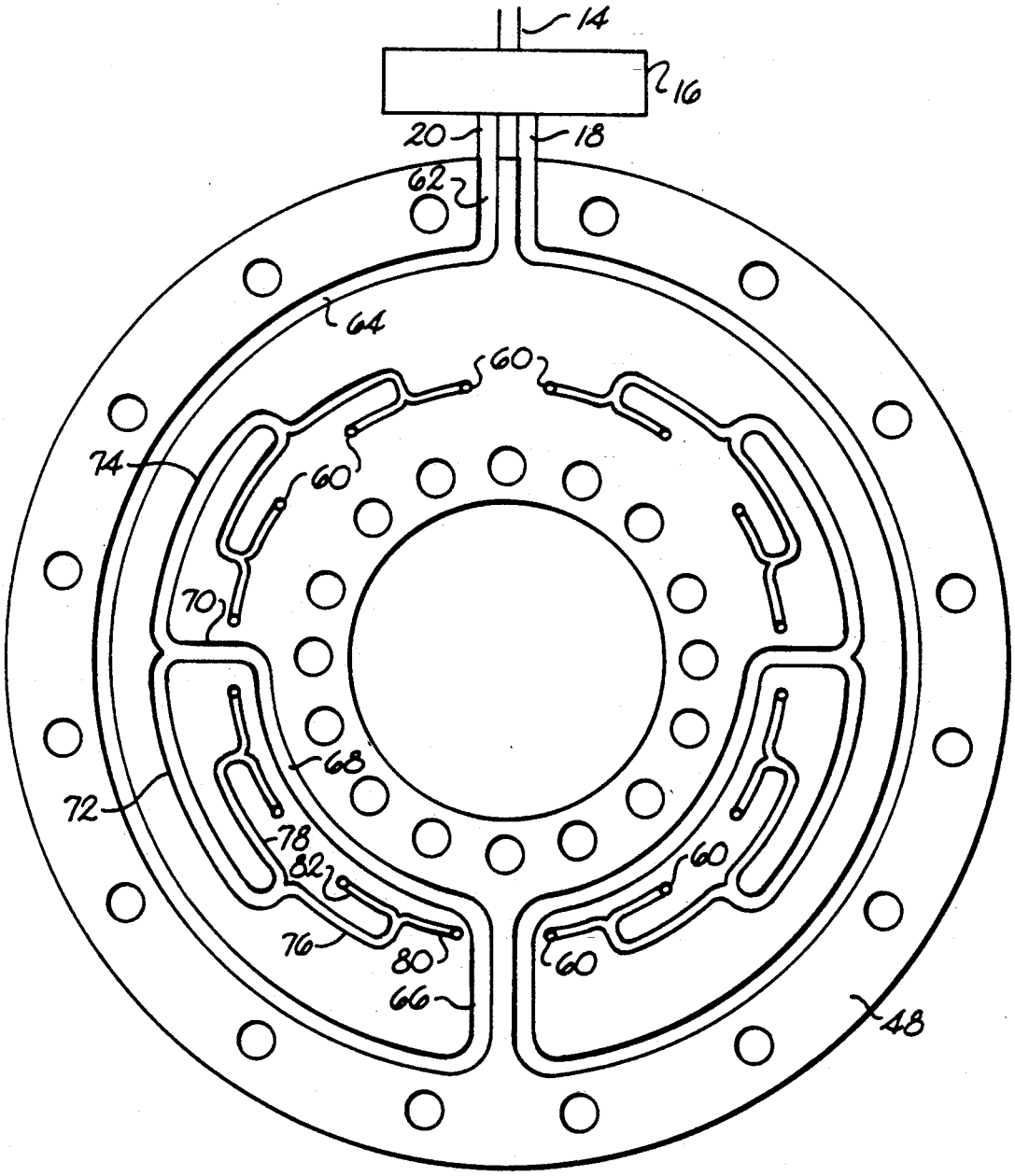
FIG. 2 is a plan view illustrating the channels for controlling the flow of molten polymeric material through the lower distribution plate.

Referring now in detail to FIGS. 1 and 2 of the drawing, there is illustrated an apparatus for compact spinning that utilizes any suitable convention melt polymeric material that is desired to be spun into individual fibers. One suitable melt for spinning is a polyester. The apparatus includes a support frame 10 which has a pack 12 secured therein. The heated melt polymeric material is fed in a stream through a channel 14 to a dual stream gear pump 16 carried on the side of the frame 10. The output of the dual stream gear pump communicates through channels 18 and 20 with the pack 12 to supply the melt to the pack to be extruded into the form of filaments 22. The melt being fed through the pack is extruded through openings provided in the spinneret 24. As the filaments exit from the spinneret 24, they are cooled by a quenching head 26. Air is supplied to the quenching head 26 for cooling the filaments by means of a fan 28 which blows air down through a vertically extending tubular housing 30 which has its lower end connected to the quenching head 26. As a result, the quenching head can be raised and lowered by means of a rack 32 carried on the outside wall of the tubular housing and a pinion gear 34 that is driven by a motor 36.

The position of the quenching head relative to the bottom of the spinneret can be varied by rotating the pinion gear in one direction or the other for raising and lowering the tubular housing 30.

The tubular housing 30 is carried within a tubular frame member 38 which is secured to the frame 10 by a bolt 40 extending through a flange 42. The pinion gear 34 and motor 36 are also mounted on any suitable fixed frame member such as illustrated at 44.

The pack 12 includes an upper distribution plate 46 and a lower distribution plate 48 into which the melt is fed through the channels 18 and 20. Positioned below the lower plate 48 is a conventional filter screen 50 through which the melt passes from the lower distribution plate to a false die 52 carried on top of the spinneret 24. The filter plate 50, false die 52 and spinneret 24 can be any suitable conventional parts that are carried within a conventional inner support ring 54 and outer support ring 56. Bolts 58 secures the entire pack 12 within the cavity provided in the frame 10.

In order to maintain uniform pressure and heat distribution of the melt as it flows through the pack, the upper and lower distribution plates 46 and 48 have a plurality of channels provided therein so that the paths of travel of the melt as it flows through the distribution plates 46 and 48 to holes 60 provided in the lower distribution plate are equal. As a result, there is equal heat distribution and pressure throughout the distribution plates as the melt flows through the distribution plates. The holes 60 provided in the lower distribution plate which communicate with the screen located directly therebelow are equally spaced in a circumferential path as shown in FIG. 2.

The two channels 18 and 20 entering into the distribution plate have identical paths to the holes 60. The channel 20 extends first through the wall of the distribution plate 48 in a radially extending direction 62 which enters into an arcuate channel 64 which is approximately 180 degrees and extends to the opposite side of the distribution plate from the input channels 18 and 20. At that point, it turns radially inwardly through a path 66 to an inner arcuate path which travels back towards the input channel 20 for approximately 90 degrees. It then turns radially outward through the channel 70 to a pair of split channels 72 and 74. The split channel 72 extends in an arcuate path for approximately 45 degrees in one direction while the split channel 74 extends for approximately 45 degrees in the opposite direction. The channel 72 then splits into two smaller arcuate paths 76 and 78 which in turn split into two still smaller arcuate paths 80 and 82 which communicate directly with the holes 60. If one would trace the path of the melt flowing through the distribution plates 46 and 48 to the holes 60, it can be seen that the path of travel of the melt is evenly distributed throughout the entire surface of the distribution plates and are of equal length to each of the holes 60 provided in the distribution plate. Since the path of travel of the melt is evenly distributed through the distribution plate and is of the same length, such maintains a constant pressure on the melt flowing through the distribution plate and produces even heat distribution throughout the distribution plate. This enhances the quality of the filaments being extruded through the spinneret 24.

An important feature of a compact spinning machine is the method of quenching the molten polymer as it exits the holes of the spinneret. In compact spinning machines, it is necessary to quench the filaments in a much shorter quenching zone than is required for conventional spinning systems.

When quenching filaments, the volume and flow of air should be controlled so as to avoid harmful turbulence. Turbulence can cause the filaments to contact each other before they are sufficiently solidified and thus stick together. Stuck filaments (sometimes called married fibers) are considered a defect in subsequent end use.

The length of the quench zone should be variable for best performance and product quality. When running filaments of fine and heavy deniers, low to high viscosity polymers and polymers with widely varying melt temperature, it is important that the quenching zone be variable for best results.

As a result, the quenching head designed in accordance with the present invention provides flexible cooling rates and volume for the quenching air used in quenching the filaments.

The quenching head includes a centrally located main body portion 84 that is attached by means of bolts 85 to the lower end of the tubular housing 30. The main body portion includes a chamber that is surrounded by a wall 88 that has circumferentially spaced ports 86 provided therein. The bottom of the chamber is in the form of an air deflection plate 87 or surface that has a conical shaped central portion 90 that extends radially outwardly to all sides into a concave air deflection surface 92. The lower plate 87 deflects air coming down the tubular housing 30 back up through the ports 86 in a smooth turning pattern so as to minimize turbulence in the air. A plurality of hubs 94, 96 and 98 are threaded onto the main body portion so that the concentric hubs 94, 96 and 98 can be rotated to vary the position of the hubs on the main body portion in a vertical direction. Each of the hubs 94, 96 and 98 define air flow passages 100, 102 and 104 which communicate with the ports 86 provided in the main body portion. The upper portions **100*a*, 102*a* and 104*a* of the passages 100, 102 and 104 are inclined upwardly to the base of the spinneret so as to define incline slits for guiding air exiting from the quenching head towards the base of the spinneret for quenching the filaments 22 being extruded therethrough. In one particular embodiment, the angle of the inclined slot 100*a* is at 30 degrees to the horizontal, the angle of the slot 102*a* is 27 degrees to the horizontal and the angle of the third cooling slot 104*a* is 25 degrees to the horizontal. In another embodiment, the angles of the slots 100*a*, 102*a* and 104*a*** range from 10 to 30 degrees.

By rotating the hubs 94, 96 and 98 on the main body portion 84, the width of the passages 100, 102 and 104 can be varied for controlling the flow of quenching air therethrough so as to minimize the turbulence in the air striking the filaments during the quenching operation. The volume and rate of air flowing through the slots would vary depending on the particular polymer being extruded.

The volume of air flowing through the slots can also be controlled by the fan 28.

Each of the hubs 94, 96 and 98 are concentric to the main body portion 84. It is important to be able to adjust the cooling action since if you cool the filaments too quickly, you can case harden the filaments and you can also possibly cause voids in the center of the filaments.

In operation, first the position of the quenching head is set in a vertical direction relative to the bottom of the spinneret 24 by use of the rack 32 and pinion gear 34 for raising and lowering the tubular housing 30. Once the position of the quenching head 26 is positioned relative to the spinneret, the hubs 94, 96 and 98 are rotated relative to each other to obtain the desired flow of air through the slots 100*a*, 102*a* and 104*a* for the particular denier yarn being extruded and the particular polymer being extruded Melt is then fed by the dual stream gear pump 16 through the channels 18 and 20 in the distribution plates. The melt travels through the channels to the holes 60. It then passes through the filter screen 50, the false die 52 through the openings provided in the spinneret 24. As the filaments are extruded through spinneret, the quenching air passing through the annular slits 100*a*, 102*a* and 104*a* cool the filaments.

It will be obvious to those skilled in the art that various changes may be made without departing from the spirit of the invention and therefore, the invention is not limited to what is shown in the drawings and described in the specification, but only as indicated in the appended claims.

What is claimed is:

1. An apparatus for extruding molten polymeric material into a plurality of filaments comprising:

a pack including;

(a) a distribution plate, and (b) a circular spinneret positioned below said distribution plate;

means for feeding molten polymeric material through said distribution plate to said circular spinneret producing a cylindrical pattern of filaments;

a quenching head carried within and below said circular spinneret and within said cylindrical pattern of filaments;

said quenching head including, (i) a cylindrical tubular main body portion;

(ii) a plurality of concentric hubs carried on said main body portion below said spinneret, (iii) each of said concentric hubs having an upwardly inclined wall at an upper portion of said hub defining a wall of an inclined annular passage which extends towards said spinneret, (iv) means for adjusting the vertical position of each of said concentric hubs producing annular passages of predetermined widths, and means for supplying quenching air to said cylindrical tubular main body portion and through said inclined passages for cooling said filaments being produced by said spinneret.

2. The apparatus as set forth in claim 1 wherein said means for adjusting the vertical position of said concentric hubs further comprises:

said concentric hubs being secured by threads to each other so that by rotating the hubs the widths of said annular passages can be varied.

3. The apparatus as set forth in claim 2 wherein said means for supplying quenching air to said cylindrical tubular main body portion includes:

an elongated vertically extending conduit having an upper end and a lower end;

a source of air connected to said upper end of said vertically extending conduit;

said lower end of said elongated vertically extending conduit being connected to said cylindrical tubular main body portion;

an air deflection plate carried in said main body portion below said concentric hubs for deflecting air coming into said tubular main body through said inclined passages.

4. The apparatus as set forth in claim 3 further comprising:

said air deflection plate having a conical shape central portion which extends into a radially extending concave portion so as to deflect air flowing through said cylindrical tubular main body portion up through said inclined passages.

5. The apparatus as set forth in claim 1 further comprising:

means for adjusting the position of said quenching head relative to said spinneret along the direction of flow of said filaments.

* * * * *